US006209288B1

(12) United States Patent
Rahn et al.

(10) Patent No.: US 6,209,288 B1
(45) Date of Patent: Apr. 3, 2001

(54) DEVICE AND PROCESS FOR LAYING BAND OR STRIP MATERIAL

(75) Inventors: Roberto E. Rahn, Enkenbach-Alsenborn (DE); Christian Lenk, Thurbenthal (CA)

(73) Assignee: Kortec GmbH, Enkenbach-Alsenborn (DE)

( * ) Notice: Subject to any disclaimer, the term of this patent is extended or adjusted under 35 U.S.C. 154(b) by 0 days.

(21) Appl. No.: 09/297,120

(22) PCT Filed: Jul. 9, 1997

(86) PCT No.: PCT/DE97/01443

§ 371 Date: Apr. 23, 1999

§ 102(e) Date: Apr. 23, 1999

(87) PCT Pub. No.: WO98/18706

PCT Pub. Date: May 7, 1998

(30) Foreign Application Priority Data

Oct. 25, 1996 (DE) ..... 196 44 383

(51) Int. Cl.[7] ..... B65B 63/04
(52) U.S. Cl. ..... 53/429; 493/411; 493/414
(58) Field of Search ..... 270/42, 43, 47; 493/411, 413, 414; 53/429

(56) References Cited

U.S. PATENT DOCUMENTS 3,917,250 11/1975 Branick .
4,439,175 * 3/1984 Cimochowski et al. ..... 493/413
4,573,958 * 3/1986 Biesinger ..... 493/415
4,811,688 * 3/1989 Turner .
5,820,539 * 10/1998 Strahm ..... 493/412
5,921,064 * 7/1999 O'Connor ..... 493/415

* cited by examiner

*Primary Examiner*—Eugene Kim
(74) *Attorney, Agent, or Firm*—Reed Smith LLP

(57) ABSTRACT

An apparatus for laying band-like or strip-like material is disclosed, having a carrying structure and a platform, having at least one laying arrangement, which is assigned to the carrying structure and is intended for laying the material, having at least one material-feed device, which is assigned to the laying arrangement, and having at least one receiving device, which is assigned to the platform and is intended for the material which is to be laid by the laying arrangement. The laying arrangement comprises a laying arm, which is assigned to the receiving device, and wherein the platform and the laying arm can be moved at least horizontally, in each case orthogonally with respect to one another and reversibly. The apparatus permits band-like or strip-like material of different width dimensions to be laid, any mechanical conversion of the apparatus being dispensed with, and thus ensures, despite different width dimensions, optimum utilization of the dimensions predetermined by a receiving device, wherein the material-feed device can be moved, with changing direction, in the horizontal movement direction of the platform, but with opposite orientation in relation to the platform in each case, and wherein the laying arm has a horizontal material-guidance region, over the entire width of which the material can be transported. Also specified is a process which realizes the abovementioned requirements, in particular using the apparatus so described.

31 Claims, 5 Drawing Sheets

DEVICE AND PROCESS FOR LAYING BAND OR STRIP MATERIAL

BACKGROUND OF THE INVENTION a) Field of the Invention

The present invention relates to an apparatus for laying band-like or strip-like material, having a carrying structure and platform, having at least one laying arrangement, which is assigned to the carrying structure and is intended for laying the material, having at least one material-feed means, which is assigned to the laying arrangement, and having at least one receiving means, which is assigned to the platform and is intended for the material which is to be laid by the laying arrangement. The laying arrangement comprises a laying arm, which is assigned to the receiving means, and the platform and the laying arm can be moved at least horizontally, in each case orthogonally with respect to one another and reversibly.

b) Description of the Related Art

Band-like or strip-like material is used in a large number of industrial-processing sectors. In particular, textile sheet-like structures such as woven fabrics, knitted fabrics and nonwovens, but also paper products, natural products, synthetic products or metal products, or composites thereof, for example in the form of sheets, foamed and/or coated and/or fibrous products, are processed further in band form or strip form.

One possible way of preparing the band-like material or strip-like material for further processing involves direct unwinding from a roll. However, rolls constitute a problematic starting material for further processing since it is only with difficulty that small-width bands or strips can be wound on rolls. The narrower and thicker the band-like material or strip-like material, the smaller is the roll cross-section or diameter which can be achieved and handled. Consequently, it is only a short material or strip length which can be unwound from the roll.

Alternatively, or in addition, the band-like or strip-like material is thus introduced or cuttled in a number of layers, in zigzag form, into receiving containers or onto receiving panels, it being possible for a considerably larger number of running meters of material to be accommodated in this case than if the material is wound on rolls. This material-laying or strip-laying process is known as "festooning", and the associated apparatus is known as a "festooner", for example, from U.S. Pat. No. 5,087,140. The apparatus in this document comprises a frame and a platform, which can be moved relative to one another. Specifically, the platform is used as a support for the laid material and, by means of a carriage, is moved back and forth in the transverse direction, beneath a laying arrangement, which is assigned to the frame. The laying arrangement comprises a laying arm, which can be pivoted backwards and forwards essentially in the longitudinal direction, and a material-feed means to the laying arm. The horizontal movement directions of the laying arm and platform are orthogonal with respect to one another. The material-feed means is fastened rigidly on the frame and essentially comprises a rear roller and a front roller, over which the material is directed to the laying arm. The movement of the rollers of the material-feed means and of the pivotable laying arm are realized via a high-outlay mechanism. Provided for this purpose, in addition to a belt drive for rotating the rollers of the material-feed means, are gear wheels which are coupled to said belt drive and are intended for transmitting the rotary movement to a pneumatic drive for the purpose of producing the pivot movement of the laying arm.

The rollers of the material-feed means and the unfolding parts of the laying arm, between which the material is directed to the receiving means, cover only a small application range of band-like or strip-like material. Firstly, the material thickness is predetermined by the small distance between a contact roller and the front roller of the material-feed means and by the distance between the unflexible unfolding parts of the laying arm and, secondly, the material width is predetermined by the distance between guiding side-border regions on the rear roller of the material-feed means and by the width of the unfolding parts of the laying arm. In practice, for precise guidance and laying of the material, the widths of the material, of the rollers of the material-feed means and of the unfolding parts of the laying arm are designed to be identical. If, for example, material of a width which is smaller than the predetermined width were to be laid, then the dimensions of the receiving means will be utilized only to an insufficient extent. Depending on where the material emerges from the laying arrangement, at least some distance would remain in relation to the boundary of the receiving means, which would impair the laying quality and quantity and would result in the laid material slipping. The above indicates that, in the event of the material being changed, the known apparatus has to be equipped with a new material-feed means and with a new laying arm. This requires high outlay in terms of operation and time as well as cost-intensive, skilled operators and also requires the apparatus to be brought to a standstill.

Furthermore, U.S. Pat. No. 3,735,554 discloses an apparatus which is intended for laying band-like material and comprises a plurality of frames and a platform which can be moved relative to one another. In the case of the apparatus in question here, rather than executing any horizontal movement, the platform is moved exclusively in the vertical direction. A plurality of packing boxes are arranged on the platform and filled with material, the laying arrangements, which are arranged above the boxes, being arranged on a longitudinally displaceable frame. The laying arrangements merely comprise two rollers. The material, which emerges between the rollers of the laying arrangement, moves freely and in an unguided manner in the space above the boxes, which is disadvantageous as far as precise laying is concerned. The transverse movement, which is orthogonal with respect to the longitudinal movement of the laying arrangement and is necessary in order to utilize the volume of the packing box in the longitudinal and transverse directions for the purpose of laying the material, is realized in that the material-feed means is fitted on a transversely displaceable frame. In this case, the material is retained in a constant position between the two rollers of the laying arrangement and is transported together with the latter and within the packing box correspondingly. Variation of the band width is not possible either in the case of the apparatus in question since the band-feed means thereof comprises guide elements which are spaced apart in a fixed manner with respect to one another, predetermine the material width and the fixed-position material guidance and thus restrict the application range as far as different band or strip widths are concerned. It is thus also possible for a disadvantage to be established here in the sense that, in the event of the material being changed, the known apparatus has to be equipped with new guide elements for the material-feed means. This conversion measure also involves the apparatus being brought to a standstill and requires mechanically skilled, cost-intensive operators.

OBJECT AND SUMMARY OF THE INVENTION

Taking the apparatus which is known from U.S. Pat. No. 5,087,140 as departure point, the primary object of the invention is to specify an apparatus of the type in question which permits band-like or strip-like material of different width dimensions to be laid, any mechanical conversion of the apparatus being dispensed with. It is also intended to ensure guided laying of the material, using a laying arm, such that, despite different width dimensions, optimum utilization of the dimensions predetermined by a receiving means takes place during the material-laying operation. It is also intended to specify a process which realizes the abovementioned stipulations, in particular using the apparatus according to the invention.

The abovementioned object is achieved in accordance with the invention by an apparatus for laying band-like or strip-like material comprising a carrying structure and a platform, at least one laying arrangement which is assigned to the carrying structure and is for laying the material, at least one material-feed means which is assigned to the laying arrangement and at least one receiving means which is assigned to the platform and is for the material which is to be laid by the laying arrangement. The laying arrangement comprises a laying arm which is assigned to the receiving means. The platform and laying arm are able to be moved at least horizontally, in each case orthogonally with respect to one another and reversibly. The material-feed means is provided so that it can be displaced transversely relative to the laying arrangement. The material-feed means is able to be moved, with changing direction in a horizontal movement direction of the platform, but with opposite orientation in relation to the platform or the receiving means in each case. The laying arm has a horizontal material-guidance region over the entire width of which the material can be transported by the material-feed means.

It has been found, according to the invention, that, in the event of the material being changed, it is possible to avoid high-outlay mechanical conversion measures for the apparatus if the material-feed means of the apparatus is arranged in a movable manner rather than rigidly and can be moved horizontally, in accordance with the platform movement and orthogonally with respect to the laying arm, and if the laying arm has a horizontal material-guidance region. If, then, smaller-width material is fed, the movement of the material-feed means makes it possible to utilize the entire horizontal material-guidance region of the laying arm, said material-guidance region being covered over only partially by the smaller material width. This makes it possible to achieve precise laying even though the material width differs from that of the material-guidance region of the laying arm. The movement of the material-feed means, then, makes it possible for the material to be displaced in the material-guidance region of the laying arm such that it is possible, in principle, for the material to be laid so as to adjoin directly the boundary, the side-border region or the side wall of the receiving means. It has also been found that the dimensions predetermined by a receiving means can be utilized in optimum fashion for material laying if the movement of the material-feed means is set in relation to the movement of the platform, on which the receiving means is located. For this purpose, according to the invention, the material-feed means is moved, with changing direction, with opposite orientation in relation to the orientation of the platform in each case, it being possible for the material to emerge specifically at the respective turning point of the platform or of the receiving means. It would be conceivable in this context, for the purpose of fixing the turning point, to co-ordinate the point in time at which the material has reached a side border of the material-guidance region with the point in time at which the receiving means on the platform, which is moved in the opposite direction in relation to the horizontal material transportation, reaches the laying arm. A further particular advantage obtained from the apparatus according to the invention is that the material can be laid in very large-volume receiving means or packing cases, for example of 1200 mm in length and width.

In view of the fact that the maximum material width depends on the width of the laying arm and it is thus possible for the variation in width to be in a range which has its maximum determined by the width of the laying arm, the latter is expediently designed to be wider than the width of the material. For example, the laying arm could be double the width of the material, and it would be possible to realize dimensions of 80 mm to 40 mm. A range of approximately 100 mm–400 mm advantageously covers a very wide range of varying material widths.

In principle, the apparatus according to the invention can transport the material on the horizontal material-guidance region of the laying arm until such time as the material which is directed simultaneously in the direction of the approaching receiving means comes into the region of the receiving-means boundary or the receiving-means boundary comes into the region of the material. If the material is then laid, in the direction orthogonal to the direction of the material-feed means and platform, in the immediate vicinity of the receiving-means boundary, a change in orientation takes place, the platform moving such that the opposite receiving-means boundary is displaced in the direction of the laying arm, and the material-feed means moving such that the material is displaced in the direction of the receiving-means boundary which is now approaching from the other side.

In particular in the usual application case of a packing box into which the laying arm extends, the side borders of the material-guidance region are the determining factor for the oppositely directed change in orientation of the platform and of the material-feed means. The material moves, on the one hand, downwards, in the direction of the receiving means and, on the other hand, horizontally in the direction of a side border of the material-guidance region. The receiving means likewise moves—albeit oriented in the opposite direction and thus coming from the other side—in the direction of the same side border of the material-guidance region. The material and the inner wall of the packing box reach the side border of the material-guidance region at the same time and remain there until such time as the laying operation for one layer in the movement direction running orthogonally with respect to the platform and the material-feed means has been completed.

If the receiving means is present in the form of a packing box, the inner wall of the packing box is then located in the immediate vicinity of the side border of the material-guidance region of the laying arm. If the receiving means is a receiving pallet without side walls, then the side border of the material-guidance region is made to adjoin essentially directly the lateral side-border region of the pallet or the lateral boundary of the receiving means. Coordinating the movements of the platform and of the material-feed means in the abovedescribed manner means that it is possible not just for different material widths, but also for different receiving-means widths, to be realized.

It would also be conceivable to use packing units which have partition walls. It is likewise possible to realize a pack of large laying-arm width and smaller receiving-means width, in which case the material need not necessarily be transported horizontally as far as the side border of the material-guidance region. Furthermore, it would also be possible for the apparatus according to the invention to be used for producing semi-products or end products, for example, for the building industry, in which case mineral and/or organic insulating material is filled into formwork elements. In any case, the invention ensures that the apparatus can be equipped with an extremely wide range of different receiving means in a flexible manner and without any high-outlay mechanical conversion, and that it is possible for material of an extremely wide range of different widths and characteristics to be laid.

As far as the design of the material-feed means is concerned, it would be possible to provide a carrying arm which can be moved via horizontal drives and on which a supply mechanism is arranged. According to one exemplary embodiment, the carrying arm is a longitudinal crossmember, which is moved in the transverse direction by preferably electronically controllable horizontal drives. The horizontal drives for the longitudinal crossmember could be combined in two advancement units, the units being synchronised with one another. For the purpose of feeding the material, it would be possible to provide on the longitudinal crossmember a supply mechanism with two supply rollers, between which the material, coming from an unwinding and cutting device, is transported to the laying arrangement. A guide roller could be used to deflect the horizontally approaching material essentially in the vertical direction, towards the laying arrangement.

It has been found to be particularly advantageous to equip the material-feed means, in particular the supply mechanism, with a compensation roller for detecting tensile stressing. As a result, the tensioning of the material band or strip can be measured in the supply mechanism of the material-feed means immediately before it runs into the laying arrangement, in particular into the drive belts of the laying arm, and can be automatically corrected if there is any deviation.

In the exemplary embodiment of the invention, in which the material-feed means is moved in the transverse direction, the laying arm executes a longitudinal movement. The movement is realized with particularly low structural outlay if the laying arm is designed as a pivot arm which is driven by a pivot drive assigned to the laying arrangement. It is advantageous here if the pivot drive can be controlled, so that the angle of deflection of the laying arm can be determined. This also makes it possible, in the case of the exemplary embodiment in question, to have different length dimensioning for the receiving means or the packing box. The laying arrangement could further comprise means for monitoring the angle of deflection of the laying arm.

Transportation of the material vertically, or at least at an angle to the horizontal, in the direction of the receiving means could be achieved by the laying arm having two drive belts between which the material is moved. For the purpose of driving the drive belts, the laying arrangement could have a belt drive, which could likewise be controllable in order to set drive-belt speeds which were adapted to the material quality.

According to a particular configuration of the laying arm, the rollers each receiving one drive belt could have different diameters. For example, the rollers at the free end of the laying arm, which are furthest away from the belt drive, could have a smaller diameter than the rollers which are arranged directly at the belt drive. Such a design is advantageous for the purpose of achieving a lightweight or even filigree embodiment of the laying arm and for the purpose of utilizing the dimensions of a packing box which extends parallel to the pivot direction. On the one hand, the smaller-diameter rollers reduce the laying-arm mass which is to be moved, and thus the driving torque, which is at approximately 2000 Nm, and, on the other hand, there is a reduction in the distance between the point at which the material is discharged from the laying arm and the packing-box side wall which is adjacent in the pivot direction. In addition, the large dimensions of the rollers assigned to the belt drive ensure low, more easily manageable rotational speeds. Differences in speed or fluctuations in the belt-drive tensioning could be monitored by monitoring means.

In order that the material is transported over the length of the laying arm in a permanently and precisely guided manner, it would be possible for the laying arm to have material-guidance means. In the case of transportation between two adjacent drive belts of the laying arm, it will be possible to provide guide rollers which are arranged adjacent to the intraspace for the transportation, opposite one another and on the inside of the drive belt. In comparison with the prior art which forms the departure point for the present invention, this forced guidance makes it possible to achieve higher laying speeds of 200 m/min, in comparison with usually approximately 100 m/min.

The controllability which has been mentioned in relation to the pivot drive and the belt drive of the laying arrangement could advantageously be achieved in that there is provided in each case an electronically controllable servomotor by means of which the process parameters can be set in a freely programmable manner. For example, the speeds of the drive belts and/or the reversal speed could be set in relation to the pivot movement of the laying arm. The use of a servomotor for realizing the pivot movement has been shown to be quite particularly advantageous in relation to the use of mechanical drive means, for example crank drives. In the case of crank drives, a rotary movement is converted into a pivot movement, in which case the geometrical ratios mean that, as the dimensions of the receiving means become larger and larger, the utilization of the surface area of the receiving means becomes more and more unsatisfactory. A transmission rod, which is fastened on the circumference of the crank disk, on the one hand, and on the pivotably mounted laying arm, on the other hand, displaces the laying arm—starting from its central position—non-uniformly in any case, as a result of which not only is the space provided by the receiving means utilized incompletely, but also the laying profile is adversely affected and the material may be torn and/or blocked. The advantageously used electric drive or servomotor overcomes all these disadvantages and makes it possible to control the pivot movement of the laying arm, which can then be deflected, accelerated or slowed down as desired. This allows co-ordination with an extremely wide range of different material qualities, to be precise not just in terms of the material width, but also in terms of the thickness and, if appropriate surface character and other material properties, for example strength. Taking the parameters into account, the use of servomotors means that the material can be deposited specifically and at high speed in or on receiving means.

In addition to the already described horizontal movements and the pivot movement as well as the movement of the drive belts, it would also be possible to realize a further movement in the vertical direction, which is important in terms of achieving a laying height for the material on a pallet or in a packing box. The vertical movement could, in principle, be executed by the platform being displaced.

However, on account of the horizontal movement which already has to be executed by the platform, it has proven to be advantageous in design terms to assign this function to the carrying structure. For this purpose, the carrying structure could comprise a vertically movable stage, on which the laying arrangement is arranged. At least one vertical drive is necessary for the purpose of driving the stage. Use is preferably made of a plurality of vertical drives which are connected electronically to one another.

According to a further advantageous configuration of the apparatus according to the invention, it would be possible to arrange on the stage holding-down means, which act on the laid material as soon as a change in orientation of the laying arm has taken place. The holding-down means could retain the deposited material loops and push down on the preceding layer. Utilization of the space provided, for example, by a packing box could be optimized further as a result. The holding-down means could operate preferably pneumatically.

As in the case of driving the vertically movable stage, it would also be possible for at least one horizontal drive, but preferably a plurality of horizontal drives, to be provided for driving the horizontally movable platform, in which case said horizontal drives are likewise connected electronically to one another.

A further essential advantage of the apparatus according to the invention is that a very large number of laying points can be realized without a large number of operators or a large amount of space being required. A plurality of laying points could be arranged in pairs, in a mirror-inverted manner in a row, and it would also be possible for a plurality of rows of laying points of the apparatus to be arranged one behind the other in order thus to form an apparatus on the scale of an installation. It is possible to combine a plurality of laying points by way of design, drive and control measures, in which case a central component, such as a longitudinal crossmember, stage and platform, could be assigned individual components, such as a corresponding number of holding-down means, a corresponding number of laying arrangements and a corresponding number of receiving means. It is not just the control of the central components, but also the combination of the plurality of, preferably pairs of, laying points in groups, rows or the like which simplifies the operation of an inventive apparatus with a plurality of, namely up to 30, laying points. It is thus possible for up to 30 laying points to be operated by just two or three operators.

A particularly advantageous measure for coordinating the individual movements of the individual components of the apparatus according to the invention is constituted by the use of a control device. The control means could co-ordinate the movements in all five drive axes, these existing in respect of the horizontal drives of the material-feed means, the belt and pivot drives of the laying arrangement, the vertical drives of the carrying structure or of the stage and the horizontal drives of the platform. It should be expressly mentioned at this point in time that an apparatus according to the invention with a control device for co-ordinating the movement sequences is a quite particularly preferred embodiment. A programmable control means has proven to be particularly advantageous, with the result that programs can be easily retrieved, for example, depending on the nature of-the material which is to be laid and/or on the dimensions of the receiving means or of a packing box and all the operations take place automatically.

The present invention also relates to a process to achieve the object on which this invention is based. Accordingly, the process which is known from U.S. Pat. No. 5,087,140 and is intended for laying band-like or strip-like material, it being the case that the material is guided to a laying arrangement via a material-feed means, that the material is discharged to a receiving means from the laying arrangement, and that the laying arrangement and the receiving means are moved back and forth at least horizontally and orthogonally with respect to one another, is developed according to the invention in that the material-feed means is moved back and forth in the horizontal movement direction of the receiving means, but with opposite orientation in relation to the receiving means in each case, and in that the material is transported horizontally, at least partially, over the width of a laying arm of the laying arrangement.

As far as other advantageous configurations of the process according to the invention are concerned, you are referred to the general section of the description of the apparatus according to the invention, especially since features which are also relevant to the process are explained therein.

We should re-emphasize here the automatic nature of carrying out the process according to a particularly preferred configuration, electronic control being used for driving all the movable components, in particular the material-feed means, the platform, the stage for the laying arrangement, the pivotable laying arm and the drive belts of the laying arm. Each drive could be controlled individually, all the parameters being stored or retrieved in the product-specific and program-specific manner and the process thus proceeding automatically. This too makes it possible for a large number of laying points to be operated at the same time, if appropriate, even with materials of different qualities at each laying point or each sub-unit or group, suitable parameters being selected and the parameters for central components such as the platform, if appropriate the stage and the material-feed means, corresponding.

There are, then, various possible ways of advantageously configuring and developing the teaching of the present invention. For this purpose, you are referred, on the one hand, to the appended claims and, on the other hand, to the following explanation of four exemplary embodiments of the invention with reference to the drawing. In conjunction with the explanation of the cited exemplary embodiments of the invention, generally preferred configurations and developments of the teaching are also explained.

DESCRIPTION OF THE PREFERRED EMBODIMENTS

Figure 1:
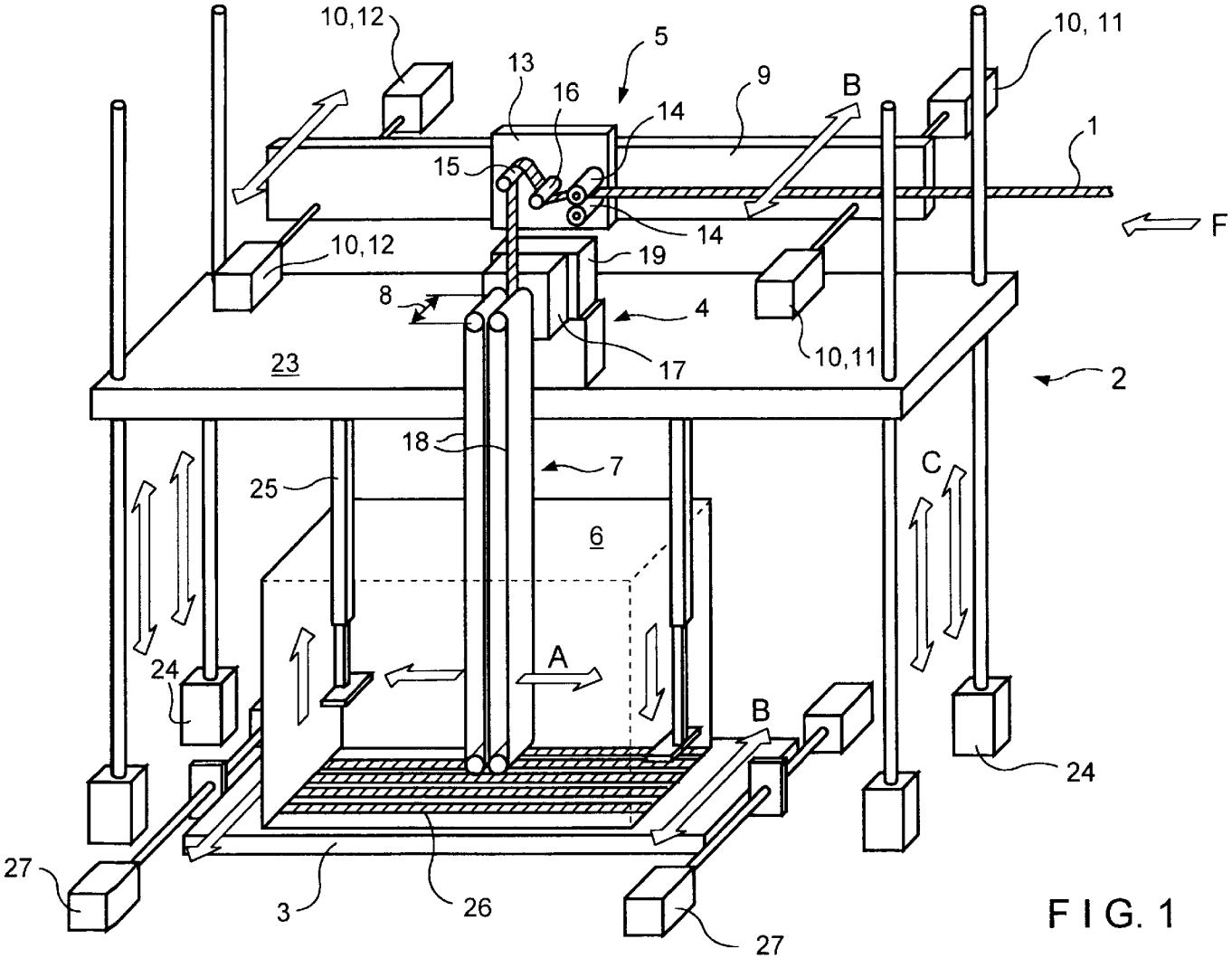
FIG. 1 shows a schematic, perspective illustration of a first exemplary embodiment of the apparatus according to the invention.

FIG. 1 shows, schematically, a first exemplary embodiment of the apparatus according to the invention for laying band-like or strip-like material 1, having a carrying structure 2 and a platform 3. The carrying structure 2 is assigned a laying arrangement 4 for laying the material 1, which is transported to the apparatus in feed direction F. A material-feed means 5 is provided above the laying arrangement 4. Located on the platform 3 is a receiving means 6, which is designed in this case as a packing box and is intended for the material 1, coming from the laying arrangement 4. For the purpose of discharging the material 1, the laying arrangement 4 has a laying arm 7 which extends into the receiving means 6. In order to illustrate the laying arm 7, the front of the receiving means 6 is indicated merely by dots and is illustrated in a more or less open state, as is also the case in FIGS. 2 and 3. The platform 3 is a component which can be moved in the horizontal direction, namely in transverse direction B. The laying arm 7 can be moved in longitudinal direction A. The platform 3 and the laying arm 7 execute orthogonal movements, to be precise reversibly, as is illustrated by the two tips of the arrows A and B.

According to the invention, it is also possible for the material-feed means 5 to be moved in the horizontal direction, namely in transverse direction B. As can be seen from FIGS. 2 and 3, the material-feed means 5, however, changes with opposite orientation in relation to the platform 3. The laying arm 7 has a horizontal material-guidance region, over the entire width 8 of which the material 1 can be transported as a result of the transverse movement of the material-feed means 5.

Figure 3:
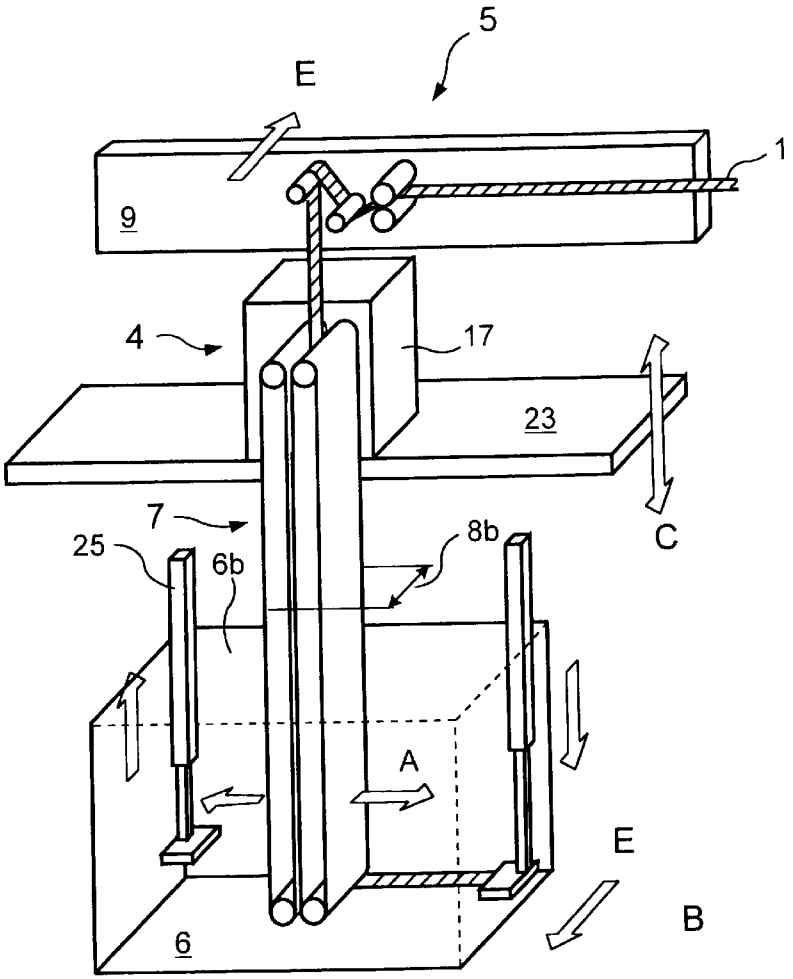
FIG. 3 shows a simplified schematic, perspective illustration of the subject matter from FIG. 1, the platform and the material-feed means being subjected to a change in orientation at a second turning point.
Figure 2:
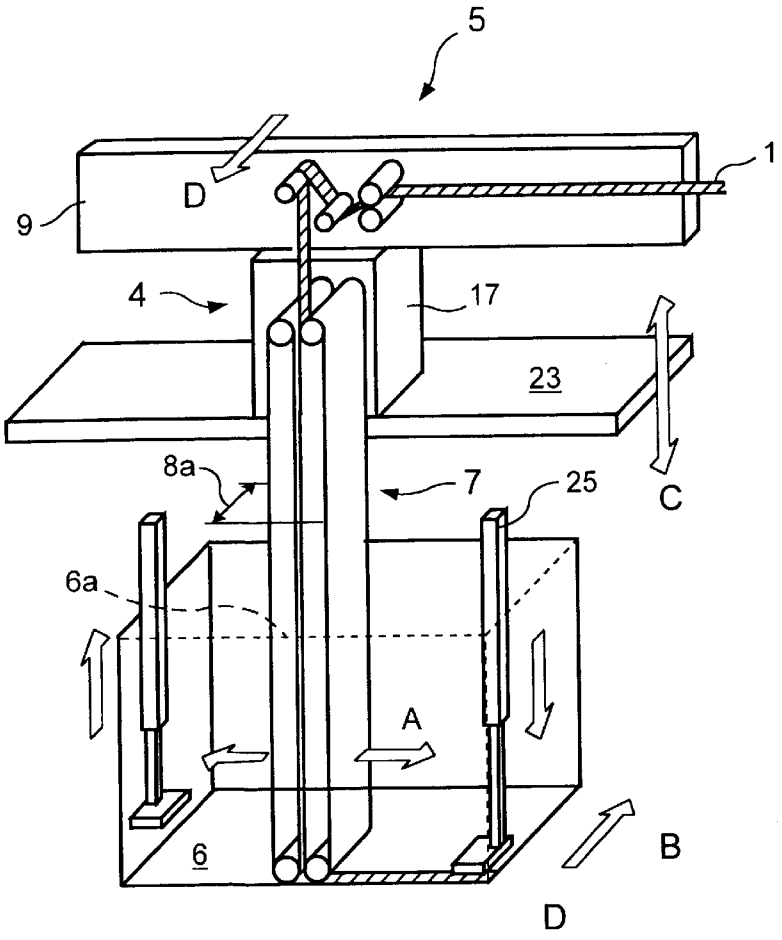
FIG. 2 shows a simplified schematic, perspective illustration of the subject matter from FIG. 1, the platform and the material-feed means being subjected to a change in orientation at a first turning point.

As can be seen from FIGS. 1 to 3, the laying arm 7 is designed to be wider than the width of the material. In this exemplary embodiment, the width 8 is more than three times the size of the width of the material.

FIGS. 2 and 3 illustrate the change in orientation of the material-feed means 5 and of the platform 3 or, in place of the platform 3, of the receiving means 6 represented there. In FIG. 2, the receiving means 6 has been moved rearwards in transverse direction B and the material-feed means 5 has been moved forwards in transverse direction B. The material 1 is guided over the width 8 of the material-guidance region of the laying arm 7 and—together with the side border 8*a* of the material-guidance region—has reached a boundary 6a of the receiving means 6, namely the front inner wall of the box. The material-feed means 5, the receiving means 6 and the material 1 have reached the front turning point D. This position is maintained until such time as the laying arm 7, which has moved to the left there, changes the orientation of its longitudinal direction A to the right and the material 1 and the receiving means 6 are moved on, by the magnitude of the material width, counter to the turning point D in each case.

FIG. 3, then, shows the material-feed means 5, the receiving means 6 and the material 1 at the rear turning point E. The receiving means 6 has moved forwards in transverse direction B and the material-feed means 5 has moved rearwards in transverse direction B. The material 1 is guided over the width 8 of the material-guidance region of the laying arm 7 and—together with the side border 8*b* of the material-guidance region—has reached a boundary 6*b* of the receiving means 6, namely the rear inner wall of the box. This position is maintained until such time as the laying arm 7, which has likewise moved to the left there, changes the orientation of its longitudinal direction A to the right and the material 1 and the receiving means 6 are moved on, by the magnitude of the material width, counter to the turning point E in each case.

It can be seen from FIG. 1 that the material-feed means 5 comprises a longitudinal crossmember 9, which is moved in transverse direction B by means of a plurality of horizontal drives 10. In each case two horizontal drives 10 are combined in electronically controlled advancement units 11, 12. Arranged on the longitudinal crossmember 9 is a supply mechanism 13, which has two supply rollers 14, a guide roller 15 for guiding the material 1 to the laying arm 7, and a compensation roller 16 for detecting the tensile stressing in the material 1.

In all the exemplary embodiments, the laying arm 7 is designed as a pivot arm. In order to pivot the laying arm 7, the laying arrangement 4 has a pivot drive 19. The laying arrangement 4 also has a belt drive 17 for driving the two drive belts 18 of the laying arm 7. Between the drive belts 18, the material 1 is transported to the receiving means 6. In each case one pair of rollers is provided for the two drive belts 18, it being the case that the rollers according to the first exemplary embodiment of the apparatus according to the invention, said embodiment being illustrated in FIGS. 1 to 3, have the same diameters and are not indicated any more specifically, and that the rollers according to the second exemplary embodiment, which is illustrated in FIG. 4, have different diameters and are indicated by the designations 20*a*, 20*b* and 21*a*, 21*b* in FIG. 4.

Figure 4:
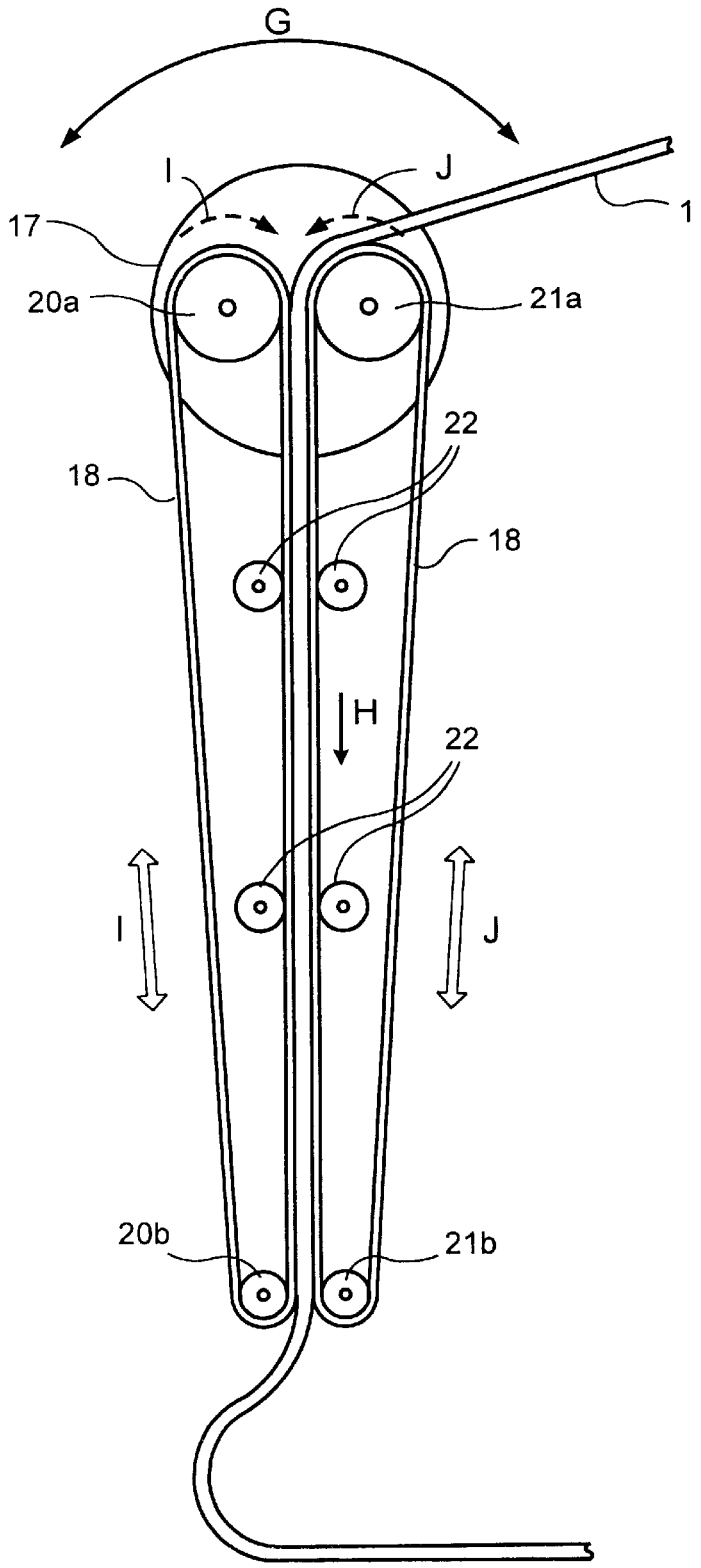
FIG. 4 shows a schematic sketch of a side view of the laying arm of a second exemplary embodiment of the apparatus according to the invention.

In the case of the laying arm 7 of a second exemplary embodiment of the apparatus according to the invention, said laying arm being shown in FIG. 4, the rollers 20*b*, 21*b* at the free end of the laying arm 7, said rollers being furthest away from the belt drive 17, have a smaller diameter than the rollers 20*a*, 20*b*, which are arranged directly at the belt drive 17. The pivot direction of the laying arm 7 is designated by G. The dotted arrows illustrate the direction of rotation I, J of the rollers 20*a* and 21*a*, which each produce the direction of circulation I, J of the drive belts 18. The belt drive 17, for its part, drives the drive belts 18. In addition, the laying arm 7 has guide rollers 22 which are arranged adjacent to the interspace for the transportation of the material 1, moved in transporting direction H, between the two drive belts 18, on the inside of the latter and opposite one another.

The pivot drive and belt drive 19, 17 of the apparatus according to the invention are present in the form of electronically controllable servomotors.

It can also be seen from FIG. 1 that the carrying structure 2 comprises a stage 23, which can be moved in vertical direction C and is driven by means of a plurality of vertical drives 24, which are connected electronically to one another, are designed as vertical lifting units and on which the stage 23 is mounted. Also provided are pneumatically operating holding-down means 25, which are shown in FIGS. 2 and 3 and, as soon as the change in orientation of the laying arm 7 in longitudinal direction A has taken place, act on the material 1 which has been laid in layers 26 in zigzag form, with changing direction, in the receiving means 6.

FIGS. 2 and 3 show, by way of example, the movement of the receiving means 6 from one side and of the material 1, or of the material-feed means 5, from the other side towards the side border 8*a*, 8*b* of the horizontally fixed laying arm 7. It can also be seen that the holding-down means 25 is lowered onto the material 1 which has been laid in the receiving means 6, while the opposite holding-down means 25 is moved upwards, in order to create space for the laying arm 7 for continued laying of the material 1.

The platform 3, which is shown in FIG. 1 and is arranged, more or less at ground level, beneath the stage 23, is moved back and forth in transverse direction B by means of a plurality of horizontal drives 27 which are connected electronically to one another.

Figure 5:
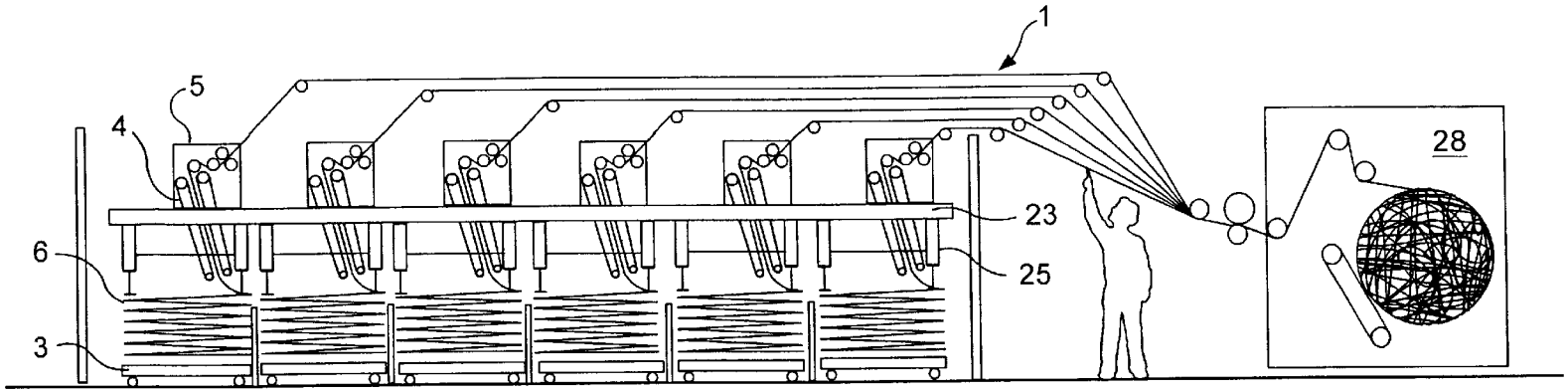
FIG. 5 shows a highly schematic basic illustration of a third exemplary embodiment of the apparatus according to the invention with a plurality of laying points in the form of an installation.

FIG. 5 illustrates a third exemplary embodiment of the apparatus according to the invention with a plurality of laying points in the form of an installation. In this case, rather than being connected to one another via a longitudinal crossmember, the material-feed means 5 are driven separately. The apparatus, which is illustrated in a front view, comprises, in three rows located one behind the other, in each case six laying arrangements 4, six receiving means 6 and six material-feed means 5. The platform 3 is separated in accordance with the receiving means 6 and is driven separately and moved horizontally via rollers, which are not indicated any more specifically. It is also possible to see an unwinding and cutting device 28 with conveying means, which are not indicated any more specifically and from which the material 1 is fed in six strands to the first row of the apparatus which can be seen from FIG. 5. It is also possible to see a vertically movable stage 23 with holding-down means 25 as well as one operator, one operator being sufficient for the purpose of monitoring the first row of laying points.

Figure 6:
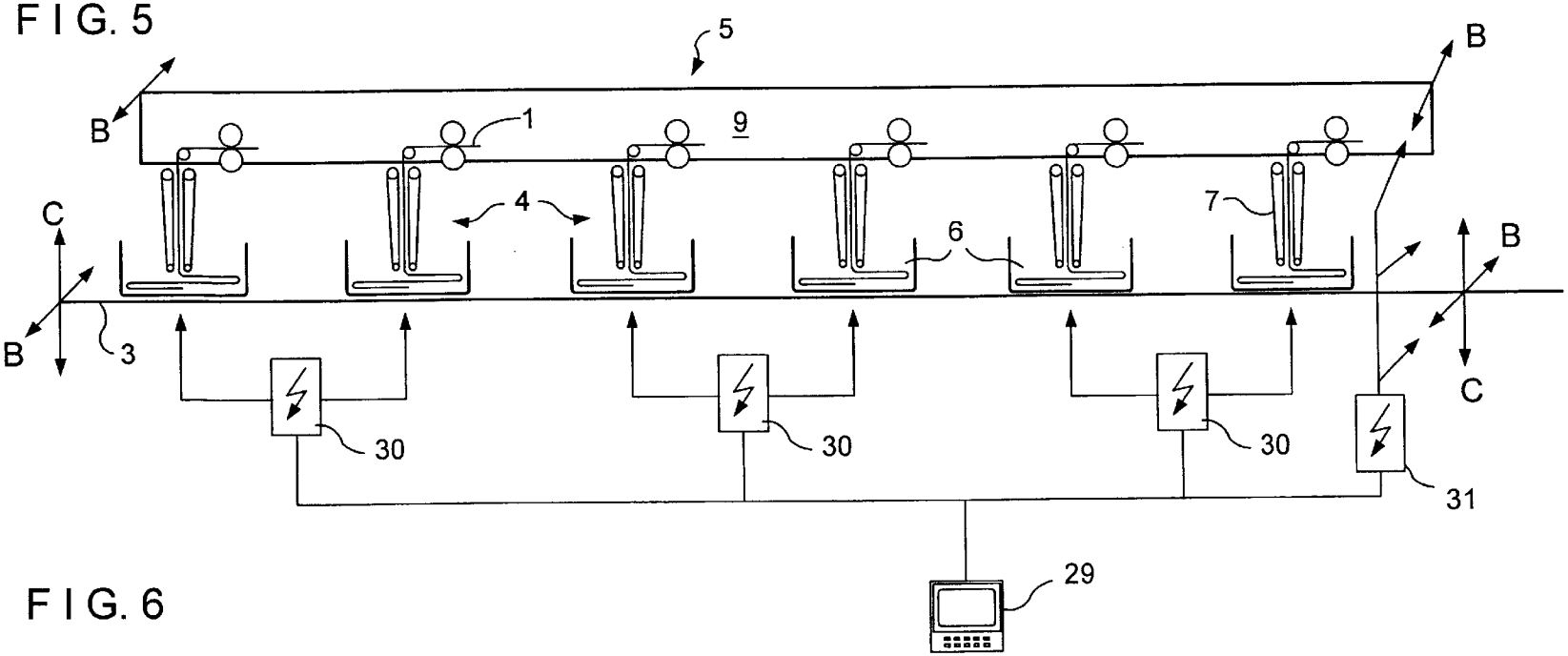
FIG. 6 shows a highly schematic basic illustration of a fourth exemplary embodiment of the apparatus according to the invention with a plurality of laying points in the form of an installation and of a control and drive arrangement.

A fourth exemplary embodiment of an apparatus according to the invention, said embodiment being expanded to form an installation with six laying points, as well as a control and drive arrangement can be seen from FIG. 6. The vertical movement C in this figure is realized by the platform 3 being lifted, it likewise being possible for said platform to be moved in transverse direction B. The control device, designated by 29, directs signals to three energy devices 30 and an energy device 31. The energy devices 30, 31 comprise actuating members (not illustrated) which act on drive members (not illustrated in this figure either) in accordance with the control function. The energy devices 30 are responsible for the pivot movement and the belt drive of the laying arm 7, while the energy device 31 drives the longitudinal crossmember 9 of the material-feed means 5 and controls the horizontal and vertical movements of the platform 3.

Figure 7:
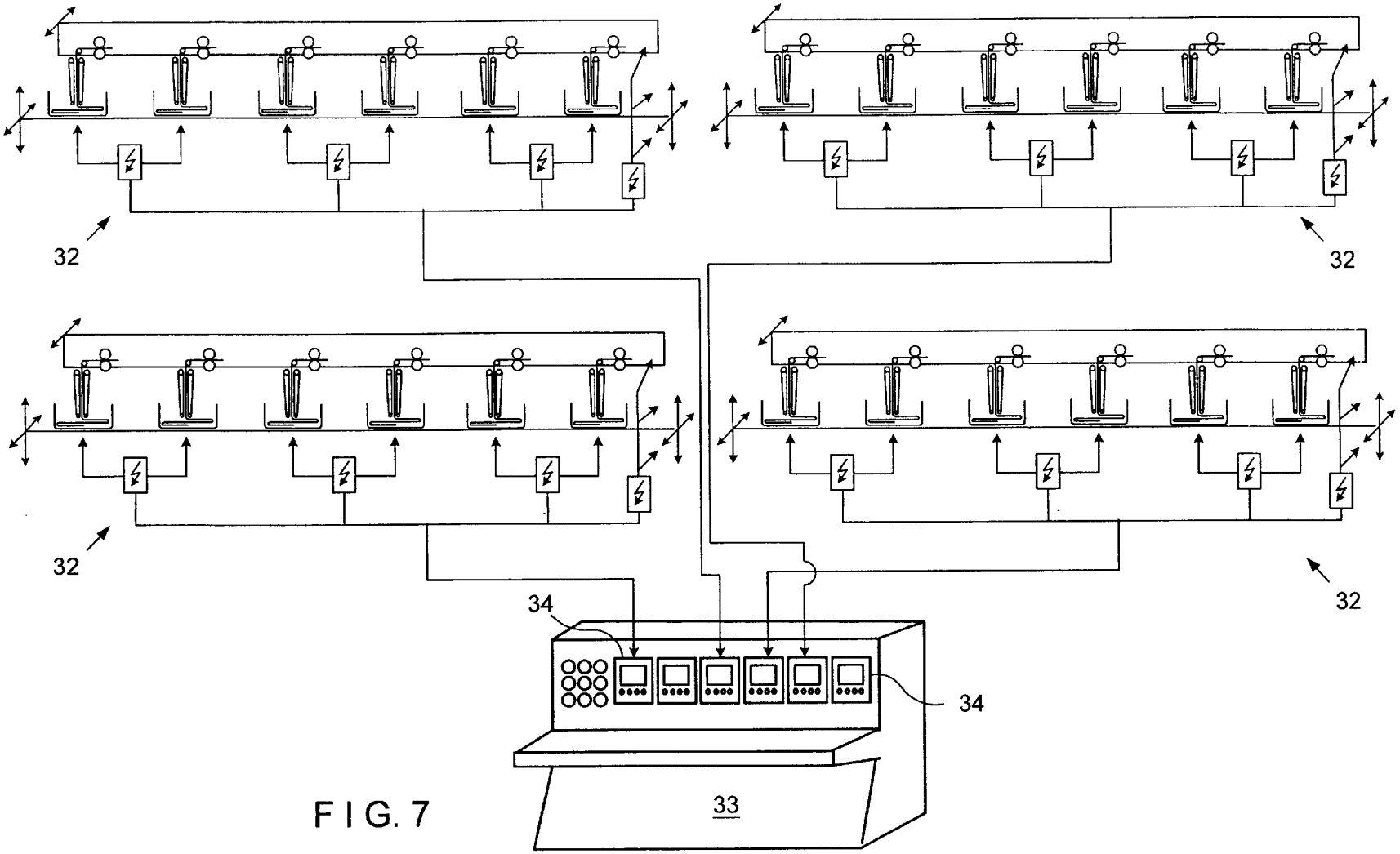
FIG. 7 shows a highly schematic basic illustration of the subject matter from FIG. 6 as one of four apparatuses with a plurality of laying points in the form of an extended system as well as of a further control and drive arrangement.

In FIG. 7, then, the fourth exemplary embodiment of the invention, said exemplary embodiment being shown in FIG. 6 and comprising six laying points, has been extended to form an even larger installation with 24 laying points, which are combined to form four groups designated by 32. Provided instead of the control device 29, which is shown in FIG. 6, is a control console 33, from which the groups 32 are controlled and driven. The two broken-away connections 34 lead to unwinding and cutting devices (not illustrated) which feed the material 1. In the control console 33, the necessary parameters are stored and retrievable in a product-specific and program-specific manner, with the result that the laying process proceeds automatically and the apparatuses operate automatically.

As far as other features which are not shown in the figures are concerned, you are referred to the general section of the description.

In conclusion, it should be pointed out that the teaching according to the invention is not restricted to the exemplary embodiments discussed above. Rather, an extremely wide range of different embodiments of the components and receiving means, as well as an extremely wide range of different control and drive arrangements, are possible.

LIST OF DESIGNATIONS

1 Material
2 Carrying structure
3 Platform
4 Laying arrangement
5 Material-feed means
6 Receiving means
7 Laying arm
8 Width of the material-guidance region of 7
8*a,b* Side border of the material-guidance region
9 Longitudinal crossmember of 5
10 Horizontal drive for 5
11 Advancement unit with 10
12 Advancement unit with 10
13 Supply mechanism of 6
14 Supply roller of 13
15 Guide roller of 13
16 Compensation roller of 13
17 Belt drive of 4
18 Two drive belts of 7
19 Pivot drive of 4
20*a,b* Pair of rollers for 17
21*a,b* Pair of rollers for 17
22 Guide rollers on 18
23 Stage of 2
24 Vertical drive for 23
25 Holding-down means on 23
26 Layers of 1
27 Horizontal drive of 3
28 Unwinding and cutting device
29 Control device
30 Energy device
31 Energy device
32 Group
33 Control console
34 Connection
A Longitudinal direction
B Transverse direction
C Vertical direction
D First turning point in transverse direction B
E Second turning point in transverse direction B
F Feed direction for 1
G Pivot direction of 7
H Transporting direction of 1
I,J Direction of rotation/circulation of 20*a*, 21*a* and 18, respectively

What is claimed is:

1. Apparatus for laying band-like or strip-like material comprising:

a carrying structure and a platform;

at least one laying arrangement, which is assigned to the carrying structure and is for laying the material;

at least one material-feed means, which is assigned to the laying arrangement;

at least one receiving means, which is assigned to the platform and is for the material which is to be laid by the laying arrangement;

said laying arrangement comprising a laying arm, which is assigned to the receiving means;

said platform and laying arm able to be moved at least horizontally, in each case orthogonally with respect to one another and reversibly;

said material-feed means being provided so that it can be displaced transversely relative to the laying arrangement;

said material-feed means being able to be moved, with changing direction, in a horizontal movement direction of the platform, but with opposite orientation in relation to the platform or the receiving means in each case; and said laying arm having a horizontal material-guidance region, over the entire width of which the material can be transported by the material-feed means.

2. The apparatus according to claim 1, wherein the laying arm is designed to be wider than the width of the material and has a width dimension of preferably approximately 100 to 400 mm.

3. The apparatus according to claim 1, wherein the change in orientation of the material-feed means and of the platform can be effected by the material, which is guided over the width of the material-guidance region, in the region of a boundary of the receiving means.

4. The apparatus according to claim 1, wherein the respective side border of the material-guidance region of the laying arm can be arranged in the region of the respective boundary of the receiving means.

5. The apparatus according to claim 1, wherein the material-feed means comprises a carrying arm which can be driven by at least one horizontal drive.

6. The apparatus according to claim 5, wherein said carrying arm is a longitudinal cross-member.

7. The apparatus according to claim 5, wherein a plurality of horizontal drives are provided for the material-feed means, and at least two horizontal drives in each case are combined in electronically controlled advancement units.

8. The apparatus according to claim 5, wherein there is arranged on the carrying arm or on the longitudinal cross-member a supply mechanism, which has supply rollers and a guide roller for guiding the material to the laying arm.

9. The apparatus according to claim 1, wherein the material-feed means, and the supply mechanism, has a compensation roller for detecting tensile stressing.

10. The apparatus according to claim 1, wherein the laying arm is designed as a pivot arm, and wherein the laying arrangement has a pivot drive for the purpose of pivoting the laying arm.

11. The apparatus according to claim 1, wherein the laying arrangement comprises a belt drive and drive belts for the laying arm, and wherein between the drive belts, the material can be transported to the receiving means.

12. The apparatus according to claim 11, wherein in each case one pair of the rollers is provided for the two drive belts, and wherein the rollers, which are furthest away from the belt drive, have a smaller diameter than the rollers, which are arranged directly at the belt drive.

13. The apparatus according to claim 1, wherein the laying arm comprises material-guidance means, which are arranged adjacent to the interspace for the transportation of the material between the two drive belts, on the inside of the latter and opposite one another.

14. The apparatus according to claim 13, wherein said material-guidance means includes guide rollers.

15. The apparatus according to claim 1, wherein at least one electronically controllable servomotor is provided for the purpose of moving or driving the laying arm.

16. The apparatus according to claim 1, wherein the carrying structure comprises a vertically movable stage.

17. The apparatus according to claim 16, wherein at least one vertical drive is provided for the purpose of driving the stage, and wherein, in the case of a plurality of vertical drives, said plurality of vertical drives are connected electronically to one another.

18. The apparatus according to claim 17, wherein there are arranged on the stage pneumatically operating holding-down means, which act on the laid material as soon as a change in orientation of the laying arm has taken place.

19. The apparatus according to claim 1, wherein at least one horizontal drive is provided for the purpose of driving the platform, and wherein, in the case of a plurality of horizontal drives, said plurality of horizontal drives are connected electronically to one another.

20. The apparatus according to claim 1, wherein the apparatus comprises at least two, and up to thirty, laying-arm arrangements and at least two, and up to thirty, receiving means and at least two, and up to thirty, material-feed means or supply mechanisms for the material-feed means.

21. The apparatus according to claim 20, wherein up to ten laying-arm arrangements, up to ten receiving means and up to ten material-feed means form a group, and wherein the apparatus comprises a plurality of groups.

22. The apparatus according to claim 1, wherein a control device is provided for controlling the horizontal drives of the material-feed means and/or the belt and pivot drives or the servomotors of the laying arm and/or for the vertical drives of the carrying structure or of the platform and/or the horizontal drives of the platform.

23. The apparatus according to claim 22, wherein the control device is programmable and/or is present in the form of an industrial computer.

24. A process for laying band-like or strip-like material using an apparatus for laying band-like or strip-like material comprising:

a carrying structure and a platform;

at least one laying arrangement, which is assigned to the carrying structure and is for laying the material;

at least one material-feed means, which is assigned to the laying arrangement;

at least one receiving means, which is assigned to the platform and is for the material which is to be laid by the laying arrangement;

said laying arrangement comprising a laying arm, which is assigned to the receiving means;

said platform and laying arm able to be moved at least horizontally, in each case orthogonally with respect to one another and reversibly;

said material-feed means being provided so that it can be displaced transversely relative to the laying arrangement;

said material-feed means being able to be moved, with changing direction, in a horizontal movement direction of the platform, but with opposite orientation in relation to the platform or the receiving means in each case; and said laying arm having a horizontal material-guidance region, over the entire width of which the material can be transported by the material-feed means;

said process comprising the steps of:

guiding the material to a laying arrangement via a material-feed means;

discharging the material to a receiving means from the laying arrangement;

moving the laying arrangement and the receiving means back and forth at least horizontally and orthogonally with respect to one another;

moving the material-feed means back and forth in the horizontal movement direction of the receiving means, but with opposite orientation in relation to the receiving means in each case; and transporting the material horizontally, at least partially, over the width of a laying arm of the laying arrangement by the material-feed means.

25. The process according to claim 24, wherein the material-feed means changes orientation when the material, which is transported over the width of the laying arm, reaches the region of a boundary of the receiving means.

26. The process according to claim 24, wherein the laying arm is pivoted.

27. The process according to claim 24, wherein the material is transported, in a guided manner, between two drive belts of the laying arm to the receiving means.

28. The process according to claim 24, wherein the laying arrangement or the receiving means is moved up and down in a vertical direction.

29. The process according to claim 24, wherein electronic control is used for driving all the movable components, including the material-feed means in one orientation of the transverse direction, a platform, which carries the receiving means, in the opposite orientation of the transverse direction, the laying arm in the longitudinal direction, if appropriate in the pivot direction, the drive belts of the laying arm in the directions of circulation, and a carrying structure, which carries the laying arrangement, in the vertical direction.

30. The process according to claim 29, wherein at least two, and up to thirty, laying points of said apparatus are controlled at the same time.

31. The process according to claim 29, wherein each drive is controlled individually, and/or wherein the corresponding parameters are stored or retrieved in a product-specific and program-specific manner and the process thus proceeds automatically.

* * * * *